US008181739B2

(12) United States Patent
Genova

(10) Patent No.: US 8,181,739 B2
(45) Date of Patent: May 22, 2012

(54) SPA STAIR APPARATUS AND METHODS WITH CONVERTIBLE STEPS

(75) Inventor: Michael C. Genova, Spokane, WA (US)

(73) Assignee: Leisure Concepts, Inc., Spokane, WA (US)

( * ) Notice: Subject to any disclaimer, the term of this patent is extended or adjusted under 35 U.S.C. 154(b) by 691 days.

(21) Appl. No.: 11/503,421

(22) Filed: Aug. 11, 2006

(65) Prior Publication Data

US 2008/0029342 A1 Feb. 7, 2008

Related U.S. Application Data

(63) Continuation-in-part of application No. 29/258,320, filed on Apr. 20, 2006, now Pat. No. Des. 550,374.

(51) Int. Cl.
*E04G 1/34* (2006.01)

(52) U.S. Cl. ..... 182/33; 182/151

(58) Field of Classification Search ..... 182/33, 182/151; 4/541.1; D6/349, 350; D25/65; 108/157.1, 158.12, 154
See application file for complete search history.

(56) References Cited

U.S. PATENT DOCUMENTS

| | | | | | |
|---|---|---|---|---|---|
| D152,153 | S | * | 12/1948 | Harvey | D6/349 |
| 2,563,436 | A | * | 8/1951 | Toth | 182/33.5 |
| D169,461 | S | * | 4/1953 | Tilley | D25/65 |
| 2,939,309 | A | * | 6/1960 | Sitton | 52/189 |
| 4,191,113 | A | * | 3/1980 | Hogberg | 108/157.16 |
| 4,458,963 | A | * | 7/1984 | Keddie | 312/237 |
| 4,744,613 | A | * | 5/1988 | Brantingham et al. | 312/235.2 |
| D297,790 | S | * | 9/1988 | Melvin | D6/350 |
| 5,158,512 | A | * | 10/1992 | Irwin et al. | 482/52 |
| 5,226,865 | A | * | 7/1993 | Chin | 482/52 |
| 5,352,031 | A | * | 10/1994 | Nahrgang | 312/235.1 |
| 5,370,447 | A | * | 12/1994 | Schneider | 297/423.45 |
| D376,923 | S | * | 12/1996 | Jones | D6/349 |
| D430,679 | S | | 9/2000 | Rodgers | |
| D485,915 | S | | 1/2004 | Robbins et al. | |
| 6,827,028 | B1 | * | 12/2004 | Callaway | 108/158.12 |
| 6,854,803 | B2 | * | 2/2005 | Tomas et al. | 297/423.41 |
| 2005/0225151 | A1 | * | 10/2005 | Zenisek | 297/423.21 |
| 2005/0236351 | A1 | * | 10/2005 | Curatolo | 211/186 |

* cited by examiner

*Primary Examiner* — Alvin Chin Shue
(74) *Attorney, Agent, or Firm* — Paine Hamblen, LLP

(57) ABSTRACT

A spa or hot tub stair assembly or apparatus having at least one step which is convertible by repositioning to provide different shaped sides. The different shaped sides can be used to better fit the outer shape of the associated spa. The individual step or steps are removable and have connection features which detachably connect with connection features upon one or more pieces forming a base. The base may be provided in the form of a pair of upright supports upon which one or more steps are supported. The assembly may advantageously be provided with one or more storage drawers or other bins which are preferably slidable for easy access.

5 Claims, 10 Drawing Sheets

SPA STAIR APPARATUS AND METHODS WITH CONVERTIBLE STEPS

CROSS-REFERENCE TO RELATED CASES

This is a continuation-in-part of U.S. patent application Ser. No. 29/258,320, filed Apr. 20, 2006, now U.S. Pat. No. D,550,374. Priority under 35 U.S.C. 120 is claimed.

TECHNICAL FIELD

Apparatuses and methods relating to spa stair assemblies having one or more detachable steps which may have different shapes to allow a step to be converted for use with differently shaped spas.

BACKGROUND OF THE INVENTION

Stair assemblies are convenient to use with many spas and hot tubs. The prior art stairs are placed against the outer wall of an elevated spa or hot tub to make it easier to step into and out of the spa or hot tub for improved or more convenient ingress and egress. Such stair assemblies or apparatuses may have one or more steps depending upon the height of the spa or hot tub and desired stair assembly height.

Although many spas and hot tubs have straight and planar outer sidewalls, others come with differing wall configurations. For example, cylindrically curved outer wall perimeters are also known.

Another problem sometimes encountered with spas or hot tubs is having a convenient place of storage for a variety of things. For example, all require chemicals and frequently there are thermometers and testing items for determining water conditions. Thus improved storage is a frequently desired with spas and hot tubs.

For convenience of discussion herein the term "spa" will be used as a common term encompassing both spas and hot tubs for interpreting the description and claims herein.

BRIEF DESCRIPTION OF THE DRAWINGS

Preferred forms, configurations, embodiments and diagrams relating to and helping to describe preferred versions of the inventions are explained, shown and characterized herein. This is often done with reference to accompanying drawings which are briefly listed below. The drawings also serve as part of the disclosure of the inventions of the current application.

DETAILED DESCRIPTION OF THE PREFERRED EMBODIMENTS

To aid in reading and using this document, included below is a listing of subsections of the detailed description:

Introductory Notes
Basic or General Configuration
Stair Assembly Base
Preferred Steps Generally
Step Shape Considerations
Step Connection to Base and Preferred Coupling Features
Storage Drawer or Bins
Preferred Symmetry of Parts
Additional Aspects of the Manner and Process of Making
Additional Aspects Concerning Manner and Process of Using
Alternative Designs
Some Additional Explanation of Benefits and Advantages
Interpretation Notes Introductory Notes The readers of this document should understand that the embodiments described herein may rely on terminology used in any section of this document and other terms readily apparent from the drawings and language common therefor as may be known in a particular art and such as provided by dictionaries. Widely known are *Webster's Third New International Dictionary, The Oxford English Dictionary* (*Second Edition*), and *The New Century Dictionary*, all of which are hereby incorporated by reference for use in helping to interpret terms used herein and for application and use of words defined in such references to describe or more adequately describe various features and aspects shown, or shown and otherwise described herein, including more appropriate words or their usages having meanings applicable to such features and aspects.

This document is premised upon using one or more terms, phrases or combinations of words or phrases used with one or more embodiments may also apply and be used to describe and define other embodiments for similar or equivalent structures, functions, features and aspects of the inventions shown and described. Wording and phraseology used in the claims and abstract is also descriptive of the inventions and the text of both is incorporated by reference into the description entirely in the form of the claims as originally filed. Terminology used with one, some or all embodiments may be used for describing and defining the technology and exclusive rights associated herewith.

Basic or General Configuration

Figure 1:
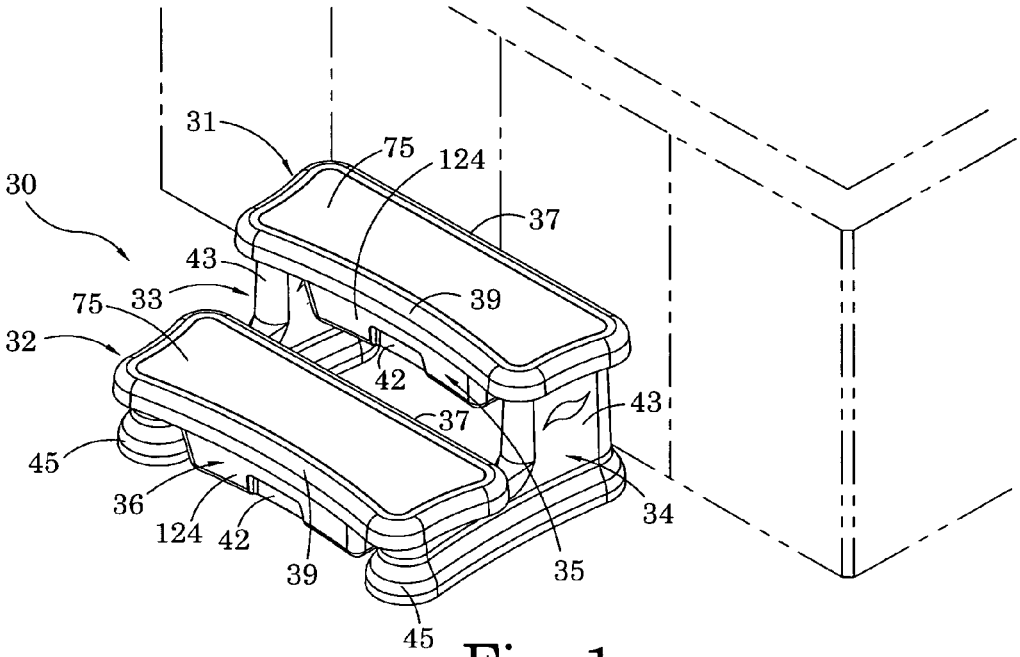
FIG. 1 is a perspective view of a preferred spa stair apparatus according to the inventions in a configuration wherein a straight edge of a top step is used to fit against or toward a spa having a straight or planar exterior side wall.
Figure 2:
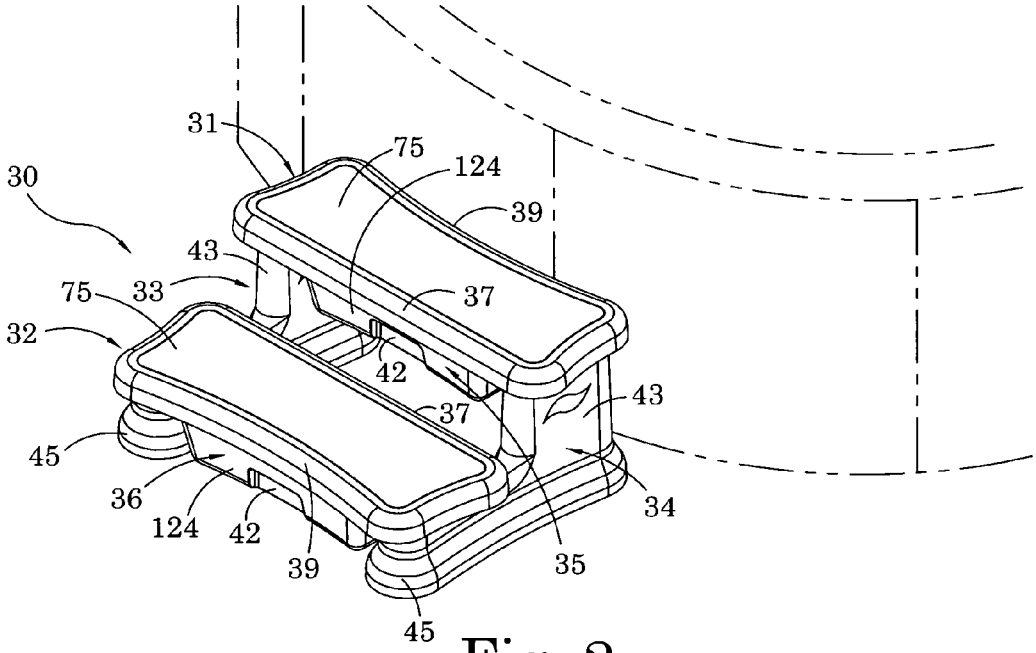
FIG. 2 is a perspective view of the apparatus of FIG. 1 with the top step reconfigured so that a curved edge is fit to a hot tub or spa having a curved exterior side wall.

Two different configurations of a preferred embodiment are illustrated by apparatus 30 as shown in FIGS. 1 and 2, respectively. The FIG. 1 apparatus 30 is shown with its top step 31 having its straight edge 37 facing toward the illustration of a straight-sided spa (shown in phantom) and its bottom step 32 having its straight edge 37 facing toward the spa. In FIG. 2 apparatus 30 is shown with its top step 31 reversed and reconfigured with its curved side 39 facing a curved-sided spa (also shown in phantom lines). The lower step 32 has not been changed and is configured the same in both FIGS. 1 and 2. Alternatively, it could also be reconfigured.

Figure 4:
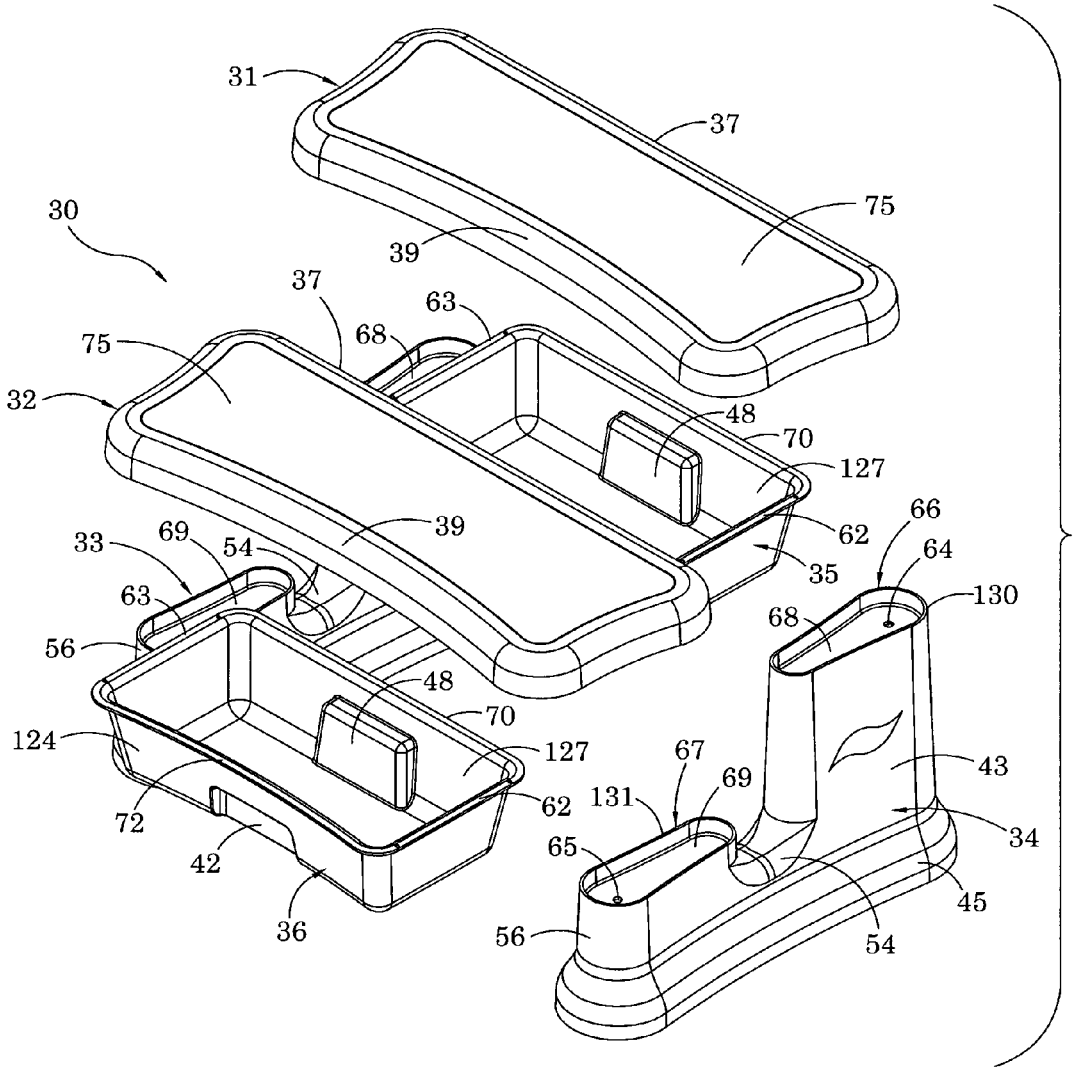
FIG. 4 is an exploded perspective view of the apparatus of FIG. 1.

In FIG. 4, the preferred embodiment of apparatus 30 is shown to be assembled from six parts 31-36. As shown, the six parts 31-36 are advantageously made in pairs or sets to minimize the molds which are required. In the construction shown there are three pairs of molded parts 31 and 32, 33 and 34, and 35 and 36. These are described and shown in greater detail in FIGS. 5-21 and each pair is made similarly. Other constructions may also be acceptable.

The three different pairs of parts are for convenience referred to as a step or steps 31, a step support or step supports 34, and a drawer, such as drawer 35. Two of each of parts 31, 34 and 35 are used to assemble the preferred embodiment. Thus, the details shown in FIGS. 5-21 are equally applicable to the other three parts 32, 33 and 36, respectively.

The manufacturing cost saving, ease of shipping and ease of assembly are inherent advantages of the preferred embodiment of the apparatus shown and described. An alternative design may be found acceptable using a single base or support member (not shown). Alternatively, some of the stair assemblies according to the inventions described herein may have only a single step member in lieu of the plurality of steps shown. The assembly is referred to as a stair assembly whether single or multiple steps are used.

Also advantageously shown is a drawer, bin or other container for storing items. As shown, the drawer is shown suspended under the at least one step, and in the illustrated embodiment both steps. To compliment the shape of the overlying step the drawer or other container may be specially shaped in a manner so as to be covered by the step. In the illustrated version the container is shaped smaller but similar to the outside edges of the step. The illustrated drawer has a curved first edge and a straight second edge, the first and second edges being along opposing longitudinal or transverse edges of the at least one container. The drawer or other container can be supported in various ways. The preferred manner is by supporting it by suspension under the step. This suspension is preferably done using drawer supports that allow the drawer to be pulled toward either the first or second edges to allow operation when the step is in either of two positions.

It is also preferable that said first and second step supports and said at least one step are constructed and otherwise adapted to allow the at least one step to be attached or detached. This is advantageously done such that the at least one step may be engaged and attached to said step support to allow conversion from a first configuration wherein the curved edge surface is exposed for abutment to a curved spa wall, and a second configuration wherein the straight edge surface is exposed for abutment to a straight spa wall. This allows the convertible spa step apparatus to be used against either a curved or a straight spa wall, or other desired shapes. The steps have spa-ward edges for direction toward the spa, and outward edges facing outwardly toward a person approaching to go up the stair assembly.

Stair Assembly Base

FIGS. 5-10 show step support 34 in greater detail. As shown, the base is formed by two step supports 33 and 34. In the preferred embodiment shown the step support 34 has two riser sections, an upper riser section 43 and a lower riser section 56. The step support 34 has a foot region 45 which may provide an interior upright space 50. This open or hollow construction of the foot and upright allows the step supports 33 and 34 to flex a limited amount and be stable on slightly irregular surfaces having non-planar irregularities, such as concrete slabs upon which many spas are placed.

Figure 6:
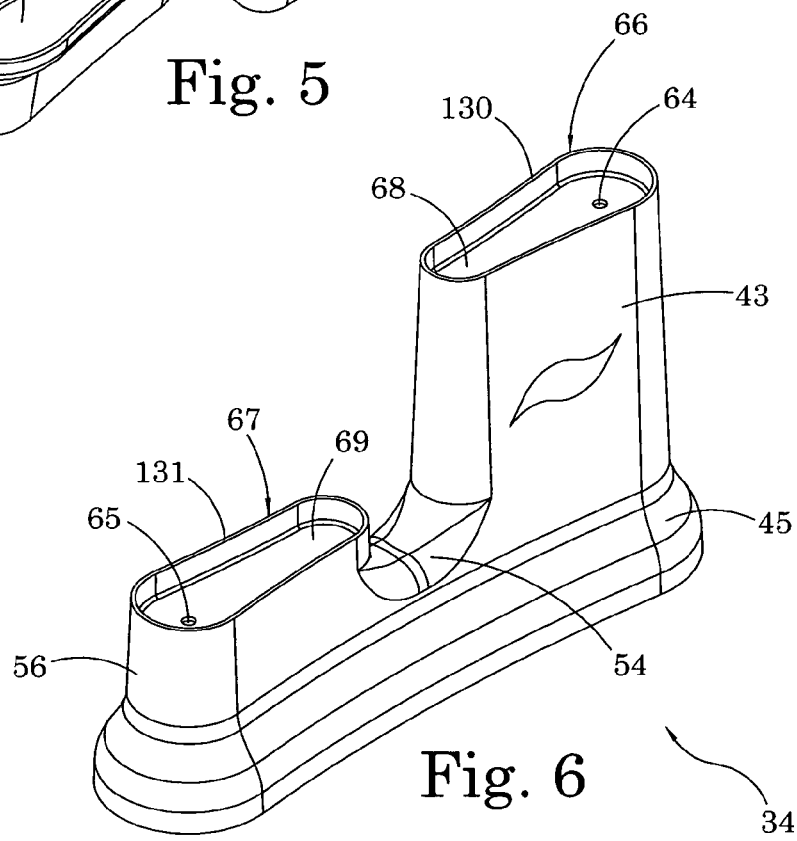
FIG. 6 is a perspective view of an end piece or support forming part of the base of the apparatus of FIG. 1.

FIG. 6 illustrates that the preferred embodiment has between the upper support region 43 and the lower support region 56, a transition provided in the form of transition curve 54 between said upper and lower support regions.

FIG. 6 also shows the supporting endpieces or step supports have features which form a support portion of a preferred upper step support coupling 66. As shown, the connection or coupling with the step includes a recess 68 and coupling rim 130. There is also a lower step support coupling 67. The upright or step support portions are advantageously provided with a recess 69 and a rim 131 on the supports or uprights.

Figure 5:
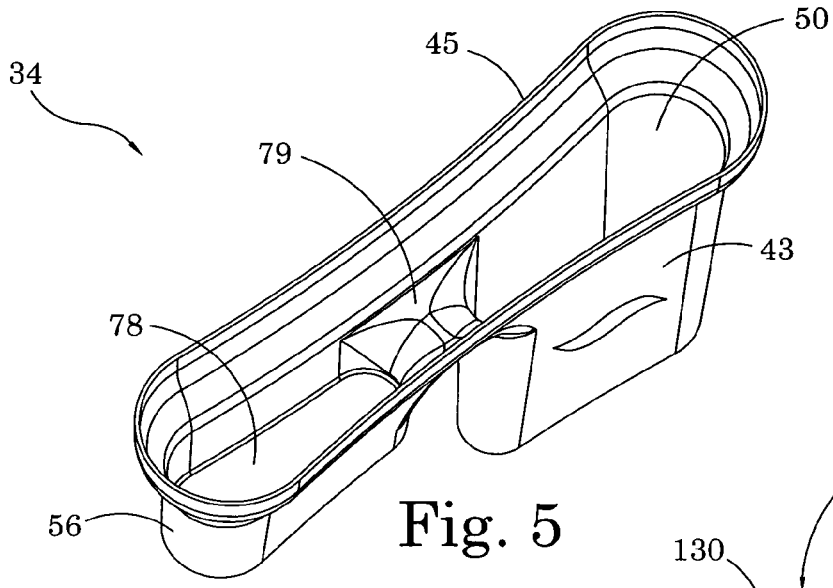
FIG. 5 is an inverted perspective view of an end piece or support forming part of the base of the apparatus of FIG. 1.

Also preferably included in recesses 68 and 69 are drain holes 64 and 65 which allow water to drain through the step support 34 in the event water enters step support coupling regions 66 or 67. FIG. 5 shows the open or hollow construction of the step support 50 which allows the water to merely drain onto the supporting surface. The underside of the coupling regions on the uprights are labeled in FIG. 5 as coupling interior spaces 78 and 79.

Preferred Steps Generally

Preferred stair apparatuses according to this invention include one or more steps that are adapted for disconnection, reconfiguration and reconnection. This allows the steps to be mounted in plural different configurations. As shown, the steps are adapted to be disconnected and removed so that they may be turned one-half turn or 180° and then be reinstalled by reconnecting the step to the base. This ability for the step connections to work at either end allows the step to be mounted in the two desired orientations.

The reversing capability that the preferred steps and preferred uprights are adapted to provide allow different shaped edges to be presented by the top step. The top step is also the proximal step because it is proximate, forward or adjacent to the spa when the stairs are positioned in an operative position as desired by the user. In the illustrated embodiment the proximal step is also the upper or top step 31.

The proximal step is made with the opposing longitudinal edges shaped differently. This allows either longitudinal edge to become the adjacent edge which abuts, engages or is merely adjacent to the spa when properly installed.

Step Shape Considerations

Figure 13:
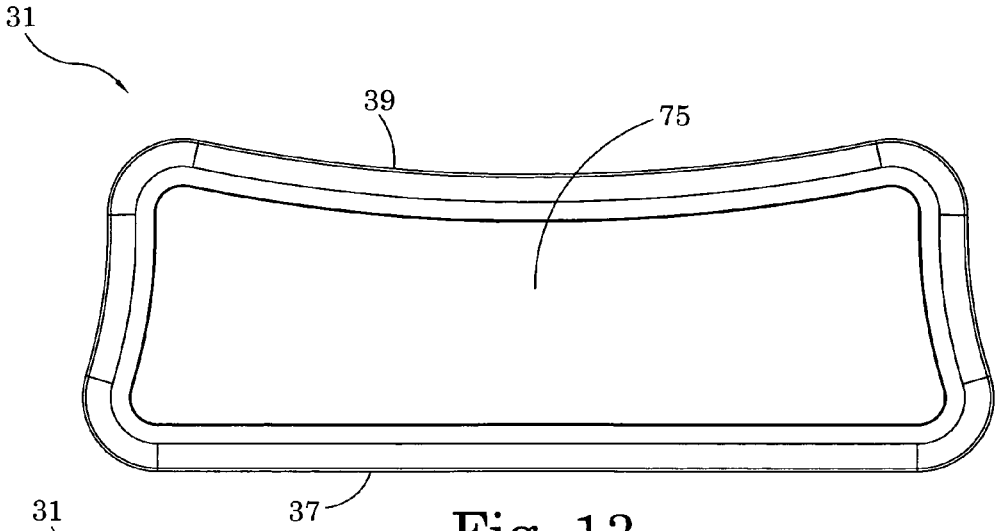
FIG. 13 is a top view of the step of FIG. 11 in isolation.

FIG. 13 shows a preferred version of the outer perimeter shape of the steps 31 and 32. Either the first longitudinal edge 37 or the second longitudinal edge 39 may be adjacent to the spa when the step is connected to the base. A preferred shape is with one edge straight and the other opposing edge curved. The straight edge is for flat side wall spas and the curved edge is for curved side wall spas.

The preferred convertible spa step apparatus comprises at least one step having a curved first edge and a straight second edge or other dissimilar shaped longitudinal or transverse edges. Transverse refers to being transverse to the line of approach. The first and second edges are along opposing transverse, longitudinal edges of the at least one step.

In addition to the straight and curved alternative adjacent edge shapes, it may alternatively be desired to use a variety of different edge shapes. For example polygonal, different curvatures, and other shapes are possible to meet the consumers desire or alternative spa shapes.

Step Connection to Base and Preferred Coupling Features

Figure 11:
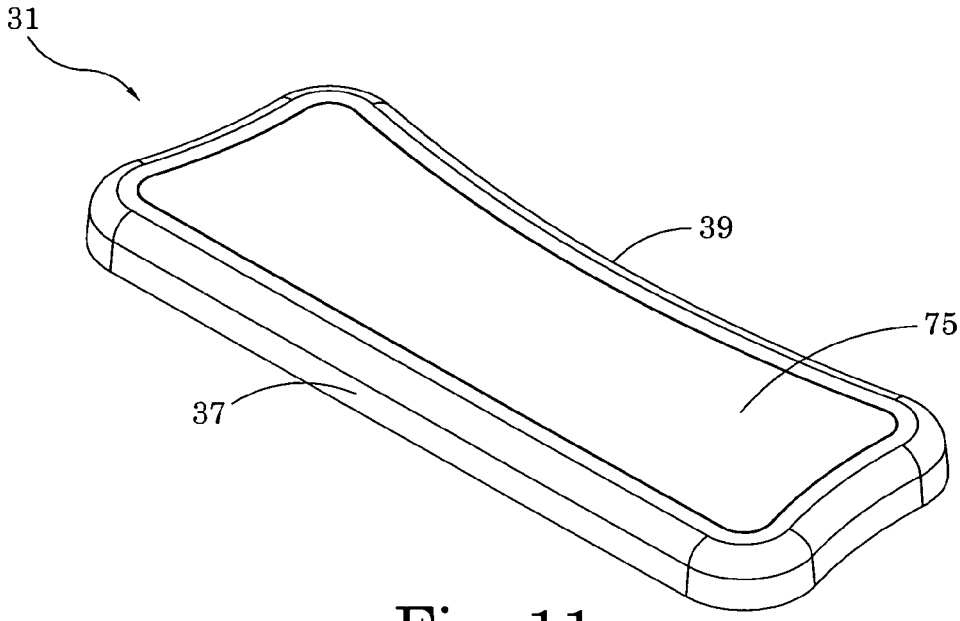
FIG. 11 is a perspective view in isolation of a step used in the apparatus of FIG. 1.
Figure 12:
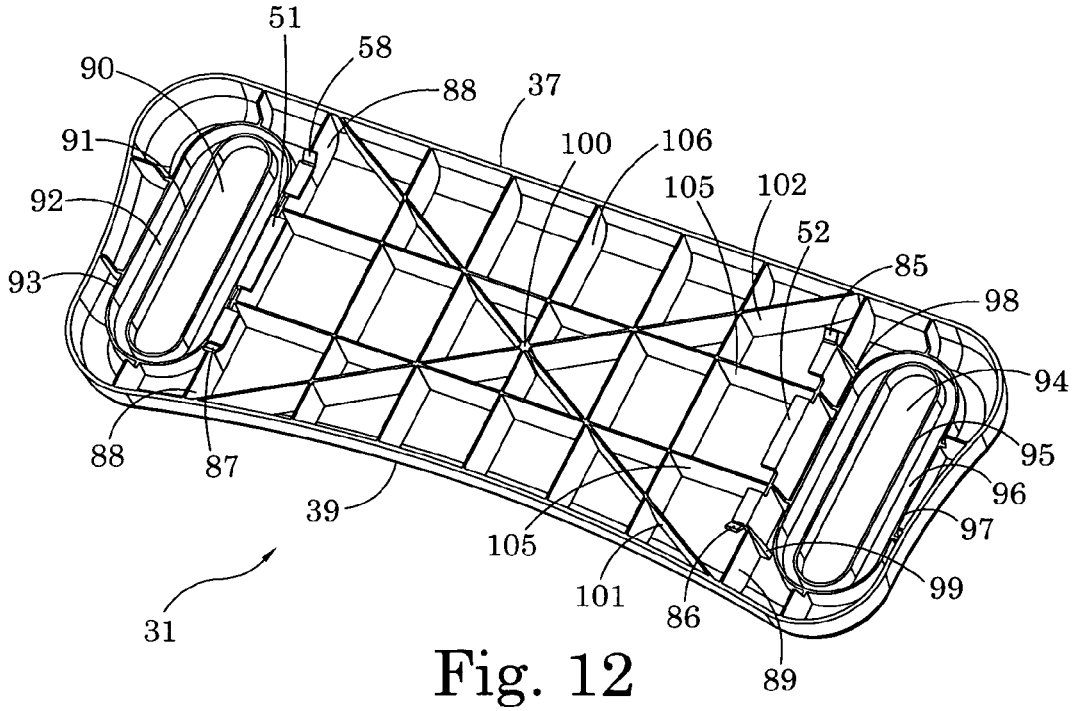
FIG. 12 is a perspective view in isolation showing the bottom side of the step of FIG. 11.
Figure 16:
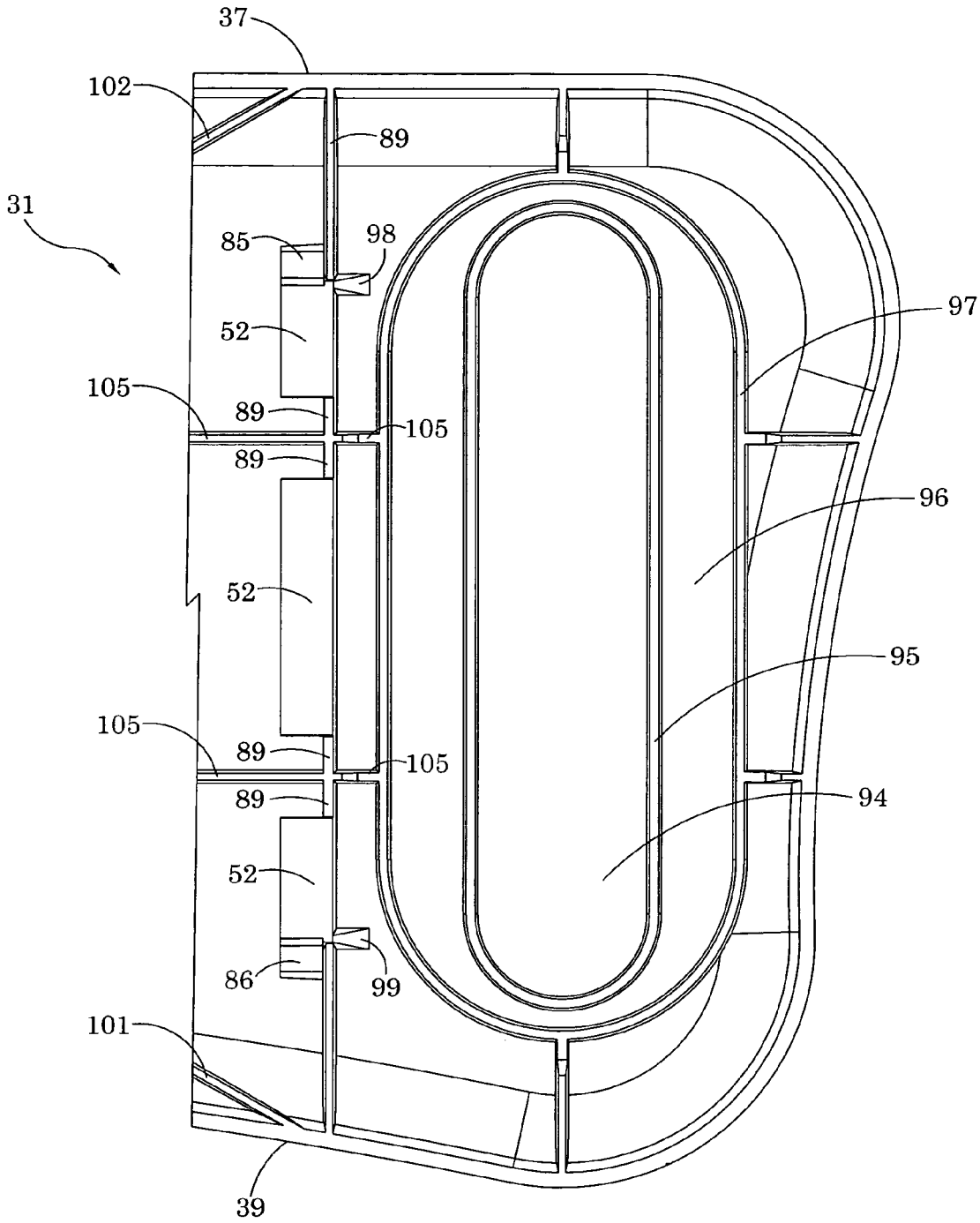
FIG. 16 is an enlarged partial bottom view of the step of FIG. 13.
Figure 17:
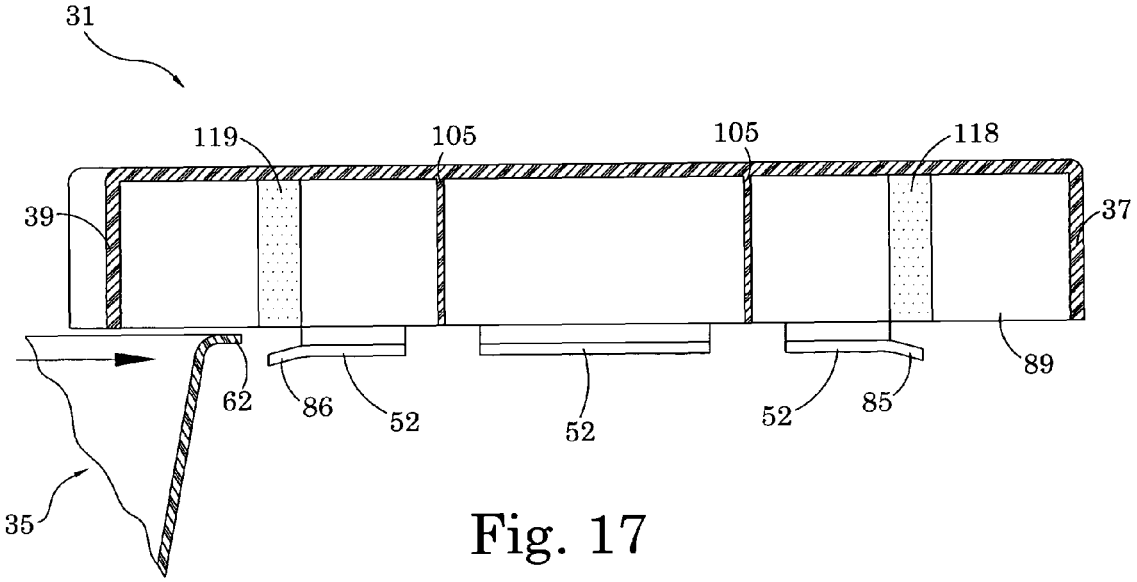
FIG. 17 is an enlarged sectional view taken along section line 17-17 of FIG. 15.
Figure 18:
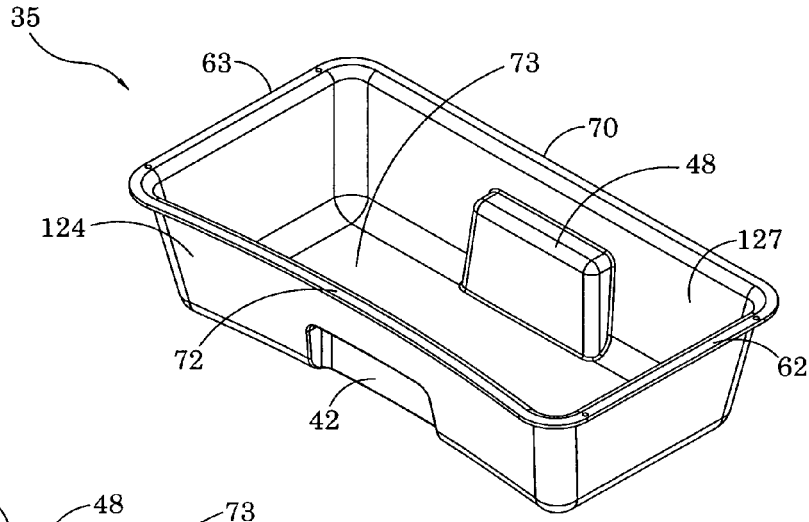
FIG. 18 is a perspective view of a storage drawer or bin in isolation which forms part of the preferred embodiment of FIG. 1.
Figure 19:
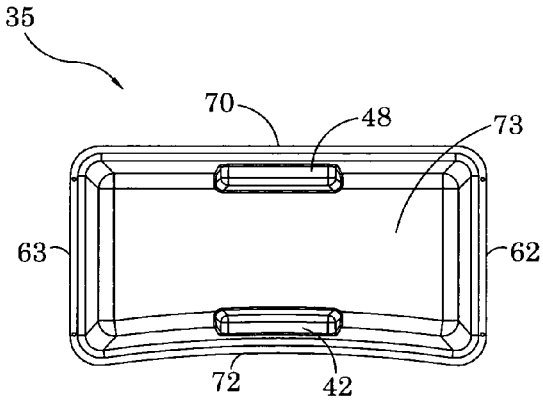
FIG. 19 is a top view of the storage drawer of FIG. 18.
Figure 20:
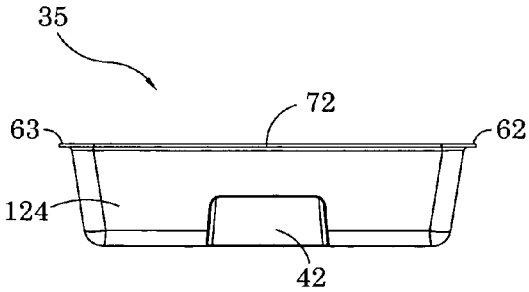
FIG. 20 is an elevational view of the storage drawer of FIG. 18.
Figure 21:
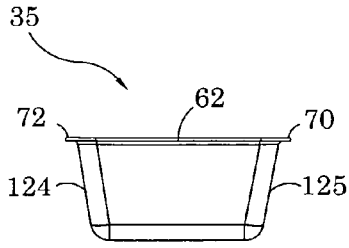
FIG. 21 is an end view of a storage drawer of FIG. 18.

FIGS. 11 through 15 show step 31 in greater detail. FIG. 16 shows an enlarged view of the step drawer hanger 52 and the step coupling region consisting of plane 94, ring 95, plane 96, and ring 97. FIG. 17 shows an enlarged cross-sectional view of step drawer hanger 52, its support rib 89 and entry ramps 85 and 86. FIG. 11 shows step 31 from a top perspective view with the curved edge 39 away and the straight edge 37 forward, and the top surface 75 of step 31. FIG. 12 shows a perspective view of the underside of step 31 with curved edge 39 forward and straight edge 37 away from the viewer.

Figure 7:
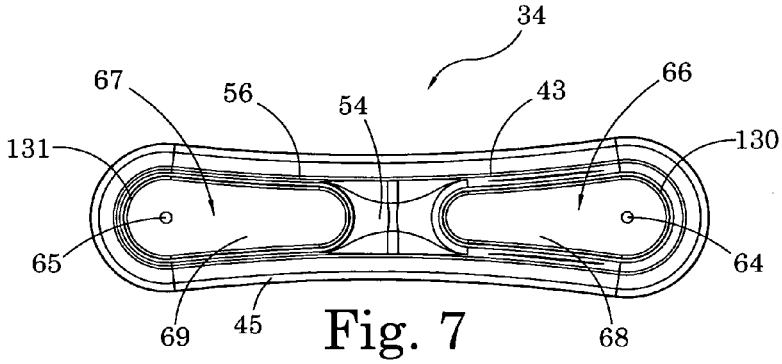
FIG. 7 is a top view of an end piece or support forming part of the base of the apparatus of FIG. 1.
Figure 8:
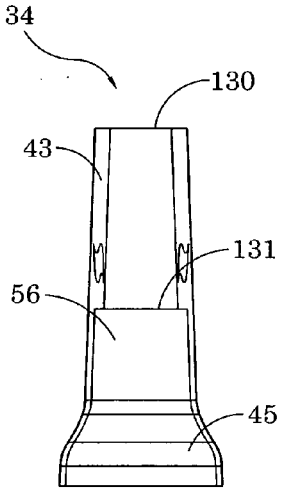
FIG. 8 is a front view of an end piece or support forming part of the base of the apparatus of FIG. 1.
Figure 9:
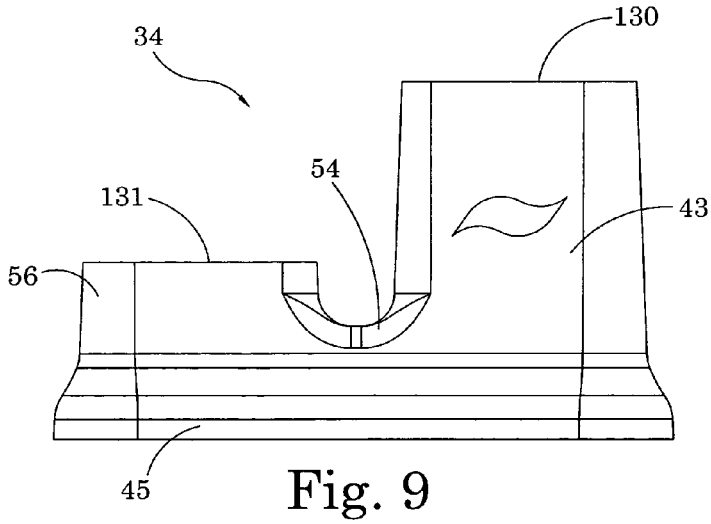
FIG. 9 is an side view of an end piece or support forming part of the base of the apparatus of FIG. 1.
Figure 10:
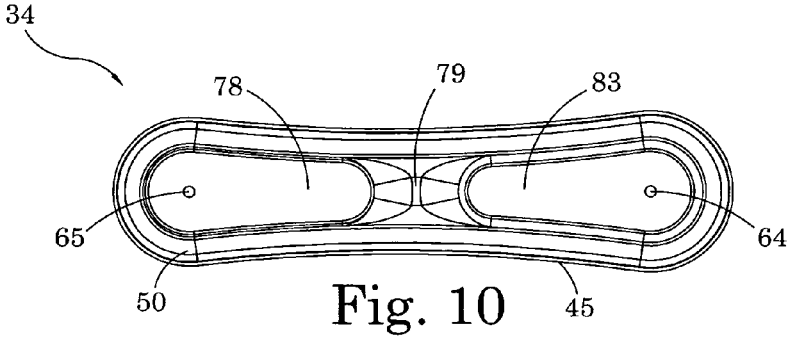
FIG. 10 is a bottom view of an end piece or support forming part of the base of the apparatus of FIG. 1.

FIGS. 4, 6, and 7 show a support or upright coupling region 66 which includes an asymmetrical oblong-shaped connection feature, coupling rim 130. Both have a larger curved end near the drain hole 64 which narrows to a smaller curve at the opposite end. A portion of the step support wall extends above asymmetrical oblong-shaped panel 68 within the similarly shaped coupling rim 130.

Figure 15:
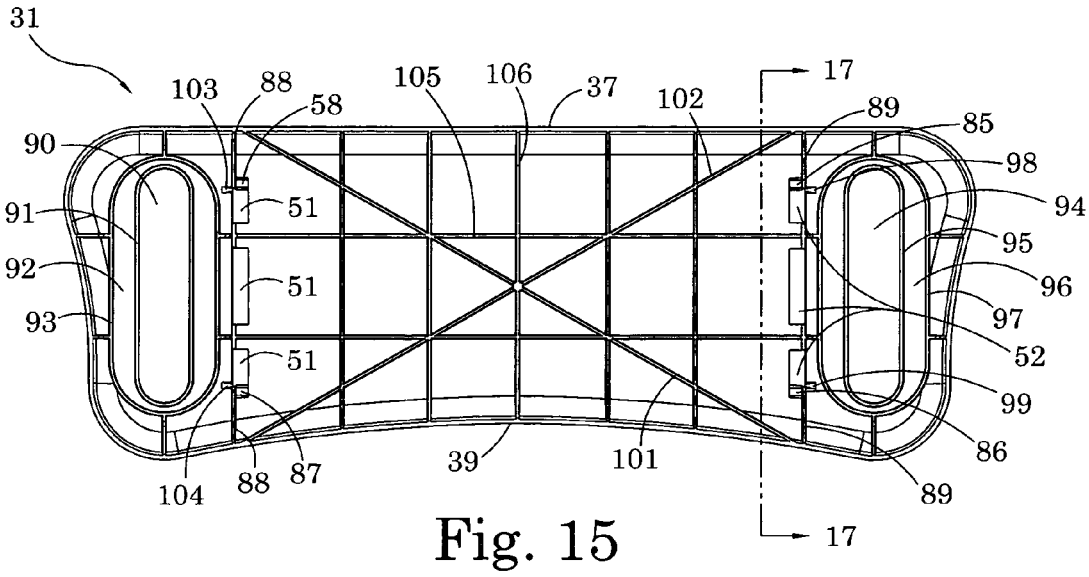
FIG. 15 is a bottom view of the step of FIG. 13.

FIGS. 12 and 15 show the step coupling region has an inner panel 94, inner ring 95, receptacle panel 96 and outer connection ring 97. The coupling rim 130 is coupled between inner and outer rings 95 and 97. The step coupling region 94-97 is positioned over the step support coupling region and the coupling rim 130, and the coupling rings 95 and 97 are pressed onto coupling rim 130 to detachably couple step 31 into place on step support 34. It can also be viewed as inserting the rim 130 between rings 95 and 97. The same method is used to detachably attach the other end of step 31 to step support 33, and to detachably attach lower step 32 to step supports 33 and 34. These attachments are frictional and are sized and shaped to engage in either configuration.

In the preferred embodiment the step support 34 has an upper riser or step support region 43 and a lower riser or step support region 56. However, the step support may also have one step support or more than two step supports and associated risers. Only step support 34 would need to be changed to accommodate a different number of step supports. The same step 31 and the same step storage drawer 35 could be used with such a modified step support 34 having any number of step support regions at various elevations.

FIG. 12 shows the underside of step 31 includes two coupling regions consisting of plane or panel 90, inner ring 91, plane or panel 92, and outer ring 93 toward one end of step 31. The other end has plane or panel 94, inner ring 95, plane or panel 96 and outer ring 97 near the opposite end of step 31. This symmetry of coupling rings 95 and 97 allows the step to be converted from its curved edge 39 outward or forward orientation (see FIG. 1) to its curved edge 39 backward or spa-ward orientation (see FIG. 2) and still couple to the step support 34 coupling region 66 and coupling rim 130 with the same coupling configuration of 94, 95, 96 and 97.

Preferred Drawer or Bin Supports

Figure 14:
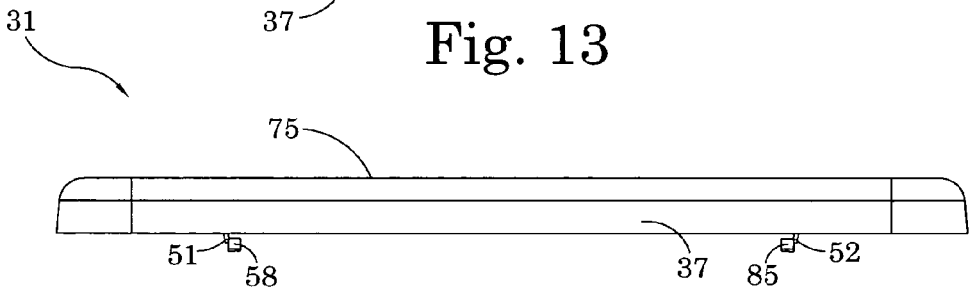
FIG. 14 is a front view of the step of FIG. 13.

FIGS. 12, 14 and 15 show that step 31 preferably has two storage drawers or other suitable bins. The drawers are preferably mounted using two step drawer hangers, 51 near one end and 52 near the opposite end.

Step drawer hanger 51 advantageously has first drawer entry 58 near the first edge and a second drawer entry 87 on the opposite, second edge. The rib supporting the step drawer hanger 51 is shown as 88. Near the opposite end is shown step drawer hanger 52 which has an entry ramp or feature 85 on one end and an entry ramp or feature 86 on the opposite end. The rib 89 supports step drawer hanger 52. The drawer support entries 58, 87, 85 and 86 make it easier to install the support edges 62 and 63 of drawer 35 onto step drawer supports 51 and 52.

The step drawer support hangers 51 and 52 advantageously have reinforced sections which are shown in FIG. 15 as 103 and 104 for step drawer support hanger 51 and for step drawer support hanger 52 as 98 and 99. Step drawer reinforcements 98 and 99 are also shown in FIG. 16.

The underside of the step 31 has a comprehensive pattern of support ribs which together are marked as 100. The ribs include longitudinal ribs 105, front-to-back ribs 106 and angled or x-shaped ribs 101 and 102.

The enlarged cross section of FIG. 17 shows the cross-sectional view along line 17-17 of FIG. 15 with a part of a drawer positioned for installation. FIG. 17 shows the rib member 89 which supports step drawer hanger 52. The figure also shows a cutaway of the central or longitudinal rib reinforcement sections 105 and the mold ejection zones 118 and 119.

FIG. 16 is an enlarged bottom view of the step 31, including step drawer hanger 52. FIG. 16 shows step drawer hanger 52 is reinforced by reinforcements 99 and 98 as well as by ribs 105.

Storage Drawer or Bins

Figure 3:
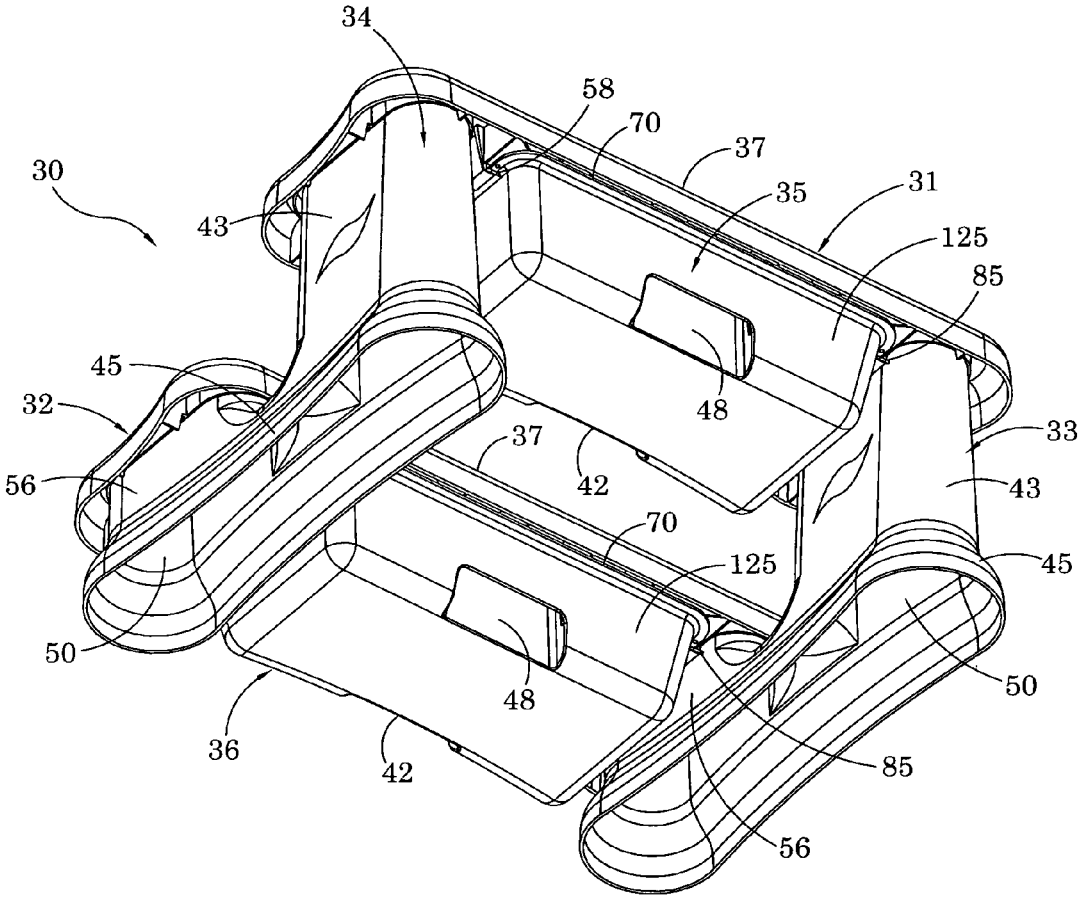
FIG. 3 is a perspective view of the apparatus of FIG. 1 from a rearward view looking from below.

FIG. 3 shows a bottom perspective view of the preferred embodiment spa stair apparatus 30. Drawer 35 is shown hung from step 31 and drawer 36 is shown hung from step 32. FIGS. 12 and 15 show the drawer hangers 51 and 52 molded as part of the bottom of the steps. Other hanger or drawer support configurations and constructions may be suitable.

Drawer 35 is shown hung by its top drawer first support edge 62 and top drawer second support edge 63. This arrangement holds the drawers under and near the bottom of their respective steps when the drawer is inserted into a stowed or closed position. This configuration reduces the likelihood of water from the spa or from rain entering the drawers. This stowed position close under step 31 helps make the drawers stay dry, such as for storing towels used after exiting the spa. There are numerous other uses for the drawers or other bins, such as for storing spa cleaning equipment, chemicals and other items.

Drawer hangers 51 and 52 allow drawer 35 to be slid into open positions or removed. The preferred construction also is designed to allow the drawers to be slid open from either way. This is desirable because the step can be converted or reversed and the preferred construction is desired for opening or removal of the drawer in either configuration.

To facilitate installation and operation of drawer 35, it has handhold 48 molded into the straight edge 70 at straight face 125, and handhold 42 molded into curved edge 129 at curved face 124. Other handle, hanger and attachment means are possible for drawers 35 and 36.

FIGS. 18-21 show drawer 35 in detail. Drawer 35 has two support edges 62 and 63 which are used to hang step drawer 35 from step support hangers 51 and 52. Drawer 35 has straight edge 70 and straight face 125, and curved edge 129 and curved face 124. The straight and curved edges advantageously correspond to straight edge 37 and curved edge 39 of step 31 or are otherwise complementary in size and shape.

To assist opening drawer 35 from either end, drawer 35 has a straight edge handhold 48 and a curved edge handhold 42. Handholds 48 and 42 are advantageously molded into faces 125 and 124, respectively. The upper region of the handholds 48 and 42 are recessed so there is an overlapping lip region for grasping.

Having the storage space slidably attached to the underside of the spa step has advantages. The weight of the storage container helps to further prevent the spa step from inappropriately disengaging from the step support. Also, since the step need not be removed to access the storage space, there is less risk for an improperly seated step.

An additional advantage of the inventions as shown is that the step storage drawer is held nearly flush under a step. This helps to prevent exposure to water from rain, snow, and common use around a spa filled with water. Thus, the storage drawer may be useful to store towels or other items that require or are best kept in dry storage.

Preferred Symmetry of Parts

The exploded view of the preferred embodiment shown in FIG. 4 shows the symmetry of the respective parts 31-36. There are two identical steps 31 and 32, two identical step supports 33 and 34, and two identical step drawers 35 and 36. Step 31 and step 32 are reversible, as are step drawer 35 and step drawer 36. The steps 31 and 32 are capable of being oriented with the curved side or the straight side back, as explained above.

Conversion of Steps

FIG. 4 shows apparatus 30 in exploded perspective view. To assemble apparatus 30, upright support 34 is connected to step 31 by coupling region 66 and coupling rim 130 of step support 34 to engage with coupling rings 95 and 97 of step 31. This is accomplished by orienting support coupling region 66 and coupling rim 130 under step coupling rings 95 and 97 and pressing the coupling rim 130 in between coupling rings 95 and 97. The larger curved end of the coupling rim engages the outer ring 97 and the smaller curve engages the inner ring 95. This captures the rim and prevents lateral movement. This coupling or connecting is effected by orienting step 31 of the step relative to the upright over step support 33 and its step support coupling region 69. Then the coupling rings are pressed onto the coupling rim 130 of the step coupling features.

These same steps are repeated for assembling step 32 to step support regions 66 and 67. Once the step and step supports are assembled, then step drawer 35 is hung onto drawer hangers 51 and 52 on support edges 62 and 63. The same procedure is followed for step 32 and drawer 36.

The assembly method is the same for an apparatus having more than two step support regions. The same assembly procedure is simply repeated as many times as there are steps, step supports, and step drawers.

Converting apparatus 30 for use with a different shaped spa is accomplished by uncoupling top step 31 by pulling them apart. Once apart, step 31 is turned so the shaped edge is adjacent to the spa exterior wall against which it best matches. Step 31 is then recoupled to step supports 34 and 33 as indicated above but in opposite orientation.

The apparatus is capable of being transformed or converted because the step 31 may be easily removed from and reattached to the step supports 33 and 34 in either direction. Once removed, step 31 may be rotated to position the curved edge 39 and the straight edge 37 in their desired positions. In one configuration both the top step 31 and the bottom step 32 may be removed and reattached to the step supports 33 and 34 on their respective high and low step support regions 43, 55, 44 and 56. This allows the step to be configured in any of four configurations.

Additional Aspects of the Manner and Process of Making

The preferred apparatus uses polypropylene for all of the injection molded parts which make up the assembly. Other materials may work suitably. Future developed materials may also be suitable to practice the inventions.

Additional Aspects Concerning Manner and Process of Using

The apparatus is used by converting the proximal or top step so that the transverse or longitudinal side having the desired shape to complement the spa is positioned along the edge which will be adjacent to the spa. The shape need not exactly fit to provide enhanced usefulness.

If the stair assembly is to be used with a different spa having a different side wall shape, then the conversion involves disconnecting the connection or connections of the top step and turning it 180 degrees or to another desired orientation depending on the particular construction used. The connection or connections are then reconnected by positioning and initially engaging the mating parts and then pressing them together. The connections as shown are designed to maintain a frictionally tight connection in either position.

Alternative Designs

This detailed description has described the preferred embodiment of the invention. Numerous other embodiments are possible, including having step shapes that are other than a straight edge and a curved edge. The step support could have one or more step support riser areas and the apparatus can be used with or without step drawers, and the step drawers may be supported upon the assembly in alternative manners.

Some Additional Explanation of Benefits and Advantages

The inventions have the advantages of simplicity of assembly and cost savings by using only three different parts. This reduces mold costs. Due to the symmetry of these parts, two of each of the three parts are all that is needed to assemble the preferred apparatus shown. The same step support part or upright can be used for either end of the apparatus. The same step may be used at each step support elevation, and the same step storage container may be used with each step.

Among the objectives of the invention are to provide a portable spa stair assembly with more conveniently accessible storage space, the flexibility to be useable with a greater number of spa shapes or configurations. It also uses only a few parts which are assembled by the user, thus allowing lower manufacturing, packaging and shipping cost.

Interpretation Notes

The invention has been described in language directed to the current embodiments shown and described with regard to various structural and methodological features. The scope of protection as defined by the claims is not intended to be necessarily limited to the specific features shown and described. Other forms and equivalents for implementing the inventions can be made without departing from the scope of concepts properly protected hereby.

I claim:

1. A convertible spa stair apparatus comprising:

two discrete treads;

two unitary base pieces, each having two tread supports at different elevations thereon for supporting one of the two discrete treads, and wherein each tread defines a curve along a front longitudinal edge and a straight edge along a back longitudinal edge, and wherein each tread is reversible by being removed from the respective tread supports, and re-installed in a first and a second configuration to position the straight edge, and curved edge abutting a spa wall to accommodate spas having straight outer sidewalls and spas with curved outer sidewalls; and wherein the two unitary base pieces and the two treads each have friction fit connection features which matingly couple together to allow the respective treads to be installed in the first configuration and in the second configuration as desired by a user, and wherein the connection feature on each of the tread supports has a recess, and a connection rim extending about the recess, and wherein the respective treads each have a bottom surface, and opposite ends, and wherein each tread defines two coupling regions on the bottom surface, and proximate the opposite ends thereof, and wherein each coupling region has an inner connection ring, and an outer connection ring that releasably engage the connection rim of the respective tread supports.

2. An apparatus according to claim 1 and further comprising at least one storage container mounted upon the apparatus for storing items therein.

3. An apparatus according to claim 1, and further comprising at least one storage container slideably mounted upon the apparatus for storing items therein, said storage container acting as a drawer.

4. An apparatus according to claim 3, and wherein the storage container may be mounted on the bottom surface of one of the treads and moved outwardly from either the curved first edge or the straight second edge thereof.

5. An apparatus according to claim 3, and wherein the storage container is covered by at least one of the treads when the storage container is located in a stowed position beneath the tread.

* * * * *